United States Patent [19]

Haub et al.

[11] 4,254,491

[45] Mar. 3, 1981

[54] PULSE CONTROL FOR AN ELECTRIC CLOCK

[75] Inventors: Martin Haub, Steinbach; Manfred Stein, Eschborn, both of Fed. Rep. of Germany

[73] Assignee: Quarz-Zeit AG, Frankfurt am Main, Fed. Rep. of Germany

[21] Appl. No.: 956,399

[22] Filed: Oct. 31, 1978

[30] Foreign Application Priority Data

Nov. 3, 1977 [DE] Fed. Rep. of Germany ..... 2749141

[51] Int. Cl.[3] ..... G04C 19/00

[52] U.S. Cl. ..... 368/85; 368/86; 368/87; 368/217; 368/218; 368/184; 318/685; 318/696

[58] Field of Search ..... 58/23 R, 23 D, 23 V, 58/28 R, 28 A, 28 D; 318/685, 696; 368/85, 86, 87, 217, 218, 219, 184

[56] References Cited

U.S. PATENT DOCUMENTS

| | | | |
|---|---|---|---|
| 3,566,600 | 3/1971 | Yoshimura et al. | 58/23 R |
| 3,937,003 | 2/1976 | Busch et al. | 58/23 D |
| 4,127,801 | 11/1978 | Leenhonts | 318/696 |

*Primary Examiner*—Ulysses Weldon

*Attorney, Agent, or Firm*—Martin A. Farber

[57] ABSTRACT

Electric clock with an oscillator, particularly a quartz oscillator, a frequency divider connected to the quartz oscillator and a control stage connected following the frequency divider, via which control stage a stepping motor, which stepping motor is coupled with the dial train, is able to be applied with pulses of the same or alternating polarity. Each pulse is formed from a number of individual pulses, the pulse duty cycle of the individual pulses reducing toward the end of the first mentioned pulses.

8 Claims, 4 Drawing Figures

PULSE CONTROL FOR AN ELECTRIC CLOCK

The invention relates to an electric clock with an oscillator, particularly a quartz oscillator, a frequency divider connected to the quartz oscillator and a control stage connected following the frequency divider, via which control stage a stepping motor, which stepping motor is coupled with the dial train or clockwork mechanism, is able to be applied with pulses of the same or alternating polarity.

Electric clocks of this type are already known, by which the stepping motor is controlled or triggered, by means of a control stage containing a capacitor, by a low frequency output of the frequency divider. By the triggering via the capacitor, the individual pulses coming from the frequency divider are deformed such that the steepness of the trailing edge is greatly reduced; in other words, at the beginning of each step of the motor rotor, a pulse portion of customary amplitude is available and consequently a sufficiently high starting torque is produced, while toward the end of the pulse the amplitude is decreased. In this manner a substantially smaller power consumption of the clock is attained in comparison to a triggering or control of the motor with the conventional rectangular pulses, and as a result a longer lifetime of the batteries, or respectively, the use of smaller batteries is possible with the same lifetime. Of disadvantage with such a solution is that the construction volume of the clock is increased, since it can only be realized with discrete components and can not be integrated in the IC.

With another known clock, for reduction of the steepness of the trailing edge of the individual pulses, a current- or voltage- divider, respectively, is provided, the individual steps or stages of this divider being switchable one after the other on and off, respectively. Such a divider may be integrated without difficulty in the existing IC, thus an increase of the construction volume does not occur. This solution however has the disadvantage that the divider is afflicted with a certain power dissipation, which unfavorably influences the rating or power output of the clock.

These disadvantages are to be overcome by the present invention.

It is therefore an object of the invention to produce a clock of the introductory-described type, having the lowest possible power required for the control or triggering of the motor rotor. Moreover the measures to be taken should be simple and be able to be realized with the smallest cost expenditure and lead to no construction volume increase, or in any event a negligible increase in the construction volume of the clock.

By this measure in a nearly non-power consuming manner, pulses for triggering and controlling of the motor are produced, by which the current-time-integral over partial pulse duration units is large at the beginning of each pulse and becomes smaller thereafter. In this manner a substantial reduction of the power consumption is achieved, whereby the means which are required for production of the pulses, as still is to be shown, can be integrated in the IC. An enlargement of the construction volume practically thus does not occur. By the invention there is provided a clock of the introductory-mentioned type in which each pulse (e.g. 4, 4') comprises a number of individual pulses (5, 5'), the pulse duty cycle of the individual pulses reducing toward the end of the first mentioned pulse.

According to a particularly advantageous embodiment of the invention in accordance with another object thereof the pulse duty factor or duty cycle of the individual pulses (e.g., 5, 5') reduces according to an exponential function. In general a reduction can take place even according to a linear or another non-linear function, however with an exponential reduction of the pulse duty cycle, there is produced a particularly small current-time-integral or voltage-time-integral, respectively, with respect to the required performance figure of the motor. Moreover such an exponential reduction of the pulse duty factor leads to a particularly small overswinging of the motor rotor at the end of its respective step. This has an effect on the seconds pointer of the clock in that the latter moves stepwise free of jumping, vibrating or shaking. Moreover lower operating noises of the clock result.

The changing, in accordance with the present invention, of the pulse duty cycle of the individual pulses, according to a further embodiment of the invention can take place in the manner that the period of time of the individual pulses (the pulse width) is changed in the sense of a reduction with simultaneously holding the spacing of the individual pulses constant (the spacing being from the beginning of one individual pulse to the beginning of the next individual pulse). Another advantageous possibility resides in changing the spacing of the individual pulses in the sense of an increase while simultaneously holding the period of time of the individual pulses constant. Finally also the period of time and the spacing can be simultaneously changed and indeed the period of time can reduced and the spacing of the individual pulses can be increased. Which of these set forth embodiment forms are finally realized in a corresponding clock depends on the already existing components and construction chips, and on the possibility to be able to use certain circuit packages or chips without change of the pregiven or predetermined wiring or circuitry.

For formation of the pulses which are made of the individual pulses, according to an advantageous embodiment of the invention, in the control stage (e.g., 6), means (8, 9, 12, 12') are provided by which different outputs (e.g. A1 to A16) of the frequency divider (2) are switchable to the output of the control stage (6).

Another advantageous possibility of the pulse formation resides in that, in the control stage, means (8, 9, 12, 12') are provided, by which means a high frequency output (A2) of the frequency divider (2) is switchable in time intervals to the output of the control stage (6). In such a case each individual pulse (5') comprises a high frequency pulse packet and consequently each pulse (4') comprises a number of high frequency pulse packets. According to an advantageous embodiment of the invention, as means, there exists a counting device (7), which counting device is fed with a high frequency pulse series from the frequency divider (2), the outputs of which counting device controlling one or more gates (13), respectively, which gates are applied with the signal or signals, respectively, of the frequency divider.

With the above and other objects and advantages in view, the present invention will become more clearly understood in connection with the detailed description of preferred embodiments, when considered with the accompanying drawings, of which:

Figure 1:
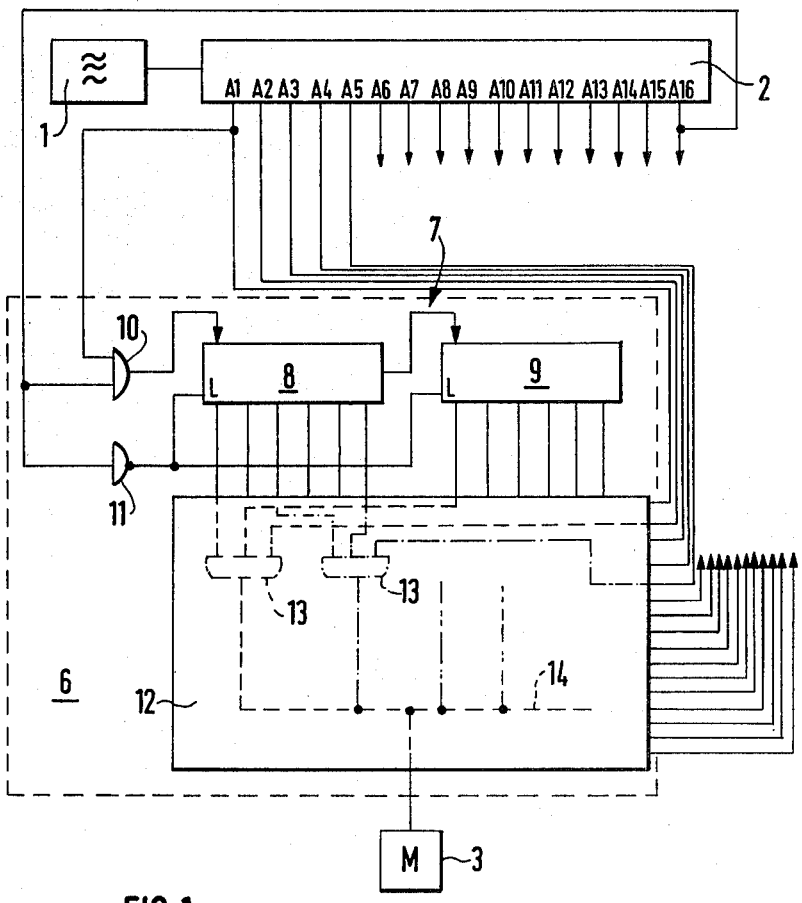
FIG. 1 is a block circuit diagram of an electric clock with a control stage in accordance with the present invention.

Referring now to the drawings and more particularly to FIG. 1, the clock according to FIG. 1, of which only the parts which are essential to the invention are illustrated, contains a quartz oscillator 1, which oscillates with a frequency of 4.194 (MHz) and a frequency divider 2 which is connected following the quartz oscillator. The frequency divider subdivides the output signal of the oscillator in several steps or stages to a signal with a frequency of 1 Hz, which latter signal appears at the output A16. This signal feeds the single phase stepping motor 3 of the known clocks, the latter being coupled to the dial train in known manner or e.g. as disclosed in patent application Ser. No. 902,435, filed May 3, 1978, the disclosure thereof hereby being incorporated herein by reference.

Figure 2:
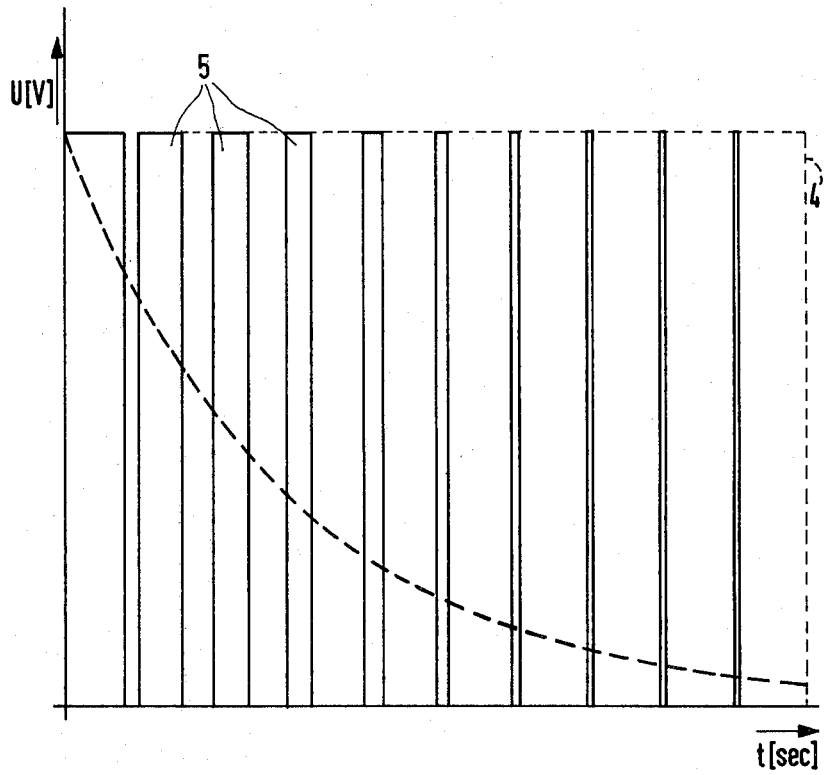
FIG. 2 is a graph showing the course of a pulse made of individual pulses, as it is emitted from the control stage of the clock according to FIG. 1.

For the formation of pulses 4 which are made of a number of individual pulses 5, the period of time of the individual pulses 5 successively exponentially decreasing with a constant time spacing of the individual pulses (such a pulse 4 being illustrated in FIG. 2), in the control stage 6 there is provided a counting device 7 with two BCD counters 8 and 9. The counting input of the counting device 7 is connected via an AND-gate 10 on the one side with the high frequency output A1 of the divider 2 and on the other side with the low frequency output A16. Moreover, the output A16 is connected via a negation member (NOT-element) 11 with the release or clearing inputs L of the counters 8 and 9.

The outputs of the counting device 7 are connected to a gate circuit 12, which gate circuit contains a number of AND gates 13, the inputs of which gates 13 are connected with selected counter outputs and frequency divider outputs, such that upon reaching certain counter contents, that AND-gate 13, respectively, which AND-gate is coordinated to or associated with this certain counter content, switches the divider output (which divider output is associated respectively with each of the certain counter contents by being connected to the respective AND-gates) to the output line 14 of the gate circuit. By a corresponding selection of the counter contents and of the frequency divider outputs to the AND-gates, pulses of the shape illustrated in FIG. 2 can be produced.

As long as no signal appears at the output A16 of the frequency divider 2, the negation member (NOT-element) 11 sends a clearing signal to the two counters 8 and 9, so that these counters are subjected to a continuous clearing for a time duration until a pulse appears at the output A16 of the divider 2. The latter mentioned pulse causes the clearing signal to end at the output of the negation member 11 and causes the AND gate 10 to switch the output A1 of the divider 2 to the counting input of the counter 8, which counter 8 consequently begins to count up with high frequency. As soon as the first predetermined counter content is reached in the counting device 7, that AND gate 13 which is associated and coordinated with this counter content switches the divider output (which divider output is associated with the previously mentioned counter content) for a certain time through to the output line 14 of the gate circuit 12. The time period while the output of the divider is switched to the output line 14, in a simple manner can be fixed or established in the manner that two or more counter contents following one another are coordinated to or associated with the individual AND gates 13, so that the prevailing respective AND gate 13 is satisfied or complied with during the occurrence of several counter contents.

Figure 3:
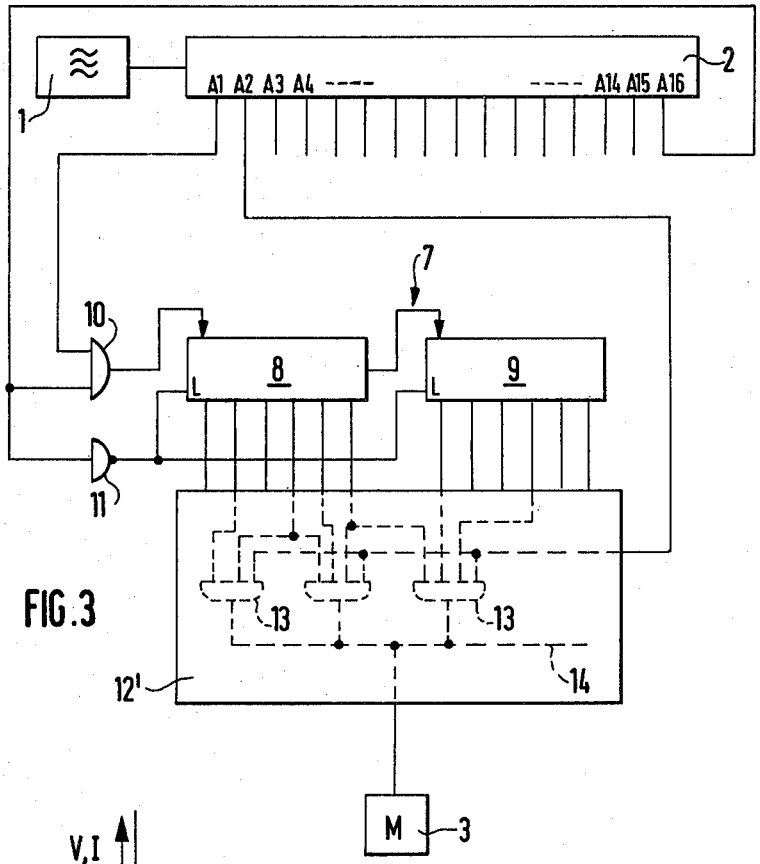
FIG. 3 is a block circuit diagram of an electric clock with a different control stage in accordance with the present invention.
Figure 4:
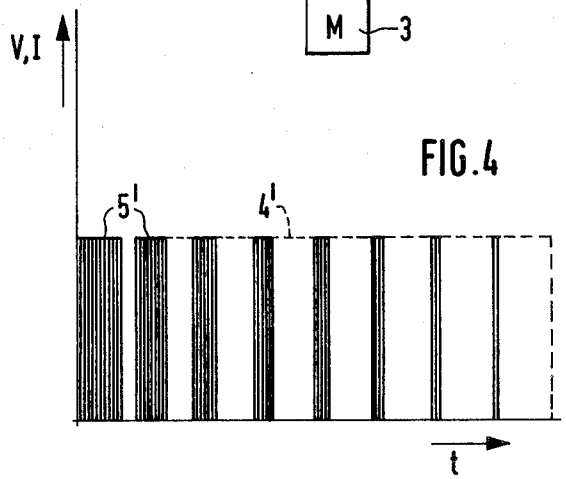
FIG. 4 is a graph showing the course of a pulse formed from individual pulses, as it is present at the output of the control stage of the clock according to FIG. 3.

With the circuit according to FIG. 3 for production of the individual pulses, a different method is used, namely a high frequency output of the divider (in the present case the divider output A2) is switched during certain times to the output 14 of the gate circuit 12'. The switched on period of time, again is controlled by means of the counter device 7 and indeed in such a manner that, to the first individual pulse 5' of each pulse 4' there is associated a larger number of successive counter contents than to the pulse 5' following the first one and so on. The individual pulses 5' of each pulse 4' thus each comprise a packet of a high frequency pulse series, as may be seen from FIG. 4.

While there has been disclosed two embodiments of the invention it is to be understood that these embodiments are given by example and not in a limiting sense.

We claim:

1. In an electric clock with an oscillator, particularly a quartz oscillator, a frequency divider connected to the quartz oscillator and a control stage connected to the frequency divider, a stepping motor coupled with the dial train of the clock and by means of the control stage is able to be applied with a plurality of control pulses, the improvement wherein said control stage includes means for forming each of the control pulses from a plurality of individual pulses such that the pulse duty cycle of the individual pulses decreases toward the end of said each of the control pulses.

2. The electric clock as set forth in claim 1, wherein the duty cycle of the individual pulses reduces according to an exponential function.

3. The electric clock according to claim 1 or 2, wherein the period of time of the individual pulses reduces toward the end of said each control pulse and the spacing of the individual pulses is constant.

4. The electric clock according to claim 1, wherein said frequency divider has a plurality of signal outputs of different frequency signals, said control stage has an output, said means switches different of said signal outputs of said frequency divider to said output of said control stage.

5. The electric clock according to one claim 1, wherein said frequency divider has a high frequency signal output, said control stage has an output, said means switches said high frequency signal output of said frequency divider in different time intervals to said output of said control stage.

6. The electric clock according to claim 4 or 5, wherein said means includes, a counting device connected to a high frequency signal output of said frequency divider, said counting device being fed with a high frequency pulse series from said frequency divider, at least one gate is connected to at least one signal output of said frequency divider, said counting device has outputs controllingly connected to said at least one gate, respectively.

7. The electric clock according to claim 6, wherein said counting device includes, an AND-gate connected to said high frequency signal output and a low frequency signal output of said frequency divider, a counter having a count input and a clearing input, said count input is connected to an output of said AND-gate, a NOT-element has an input connected to said low frequency signal output and an output connected to said clearing input.

8. In an electric clock with an oscillator, particularly a quartz oscillator, a frequency divider connected to the quartz oscillator and a control stage connected to the frequency divider, and a stepping motor which is coupled with the dial train by means of the control stage is able to be applied with control pulses, the method comprising the steps of forming each of the control pulses from a plurality of individual pulses with the pulse duty cycle of the individual pulses of each control pulse reducing toward the end of said each control pulse.

* * * * *